United States Patent [19]

Brinker

[11] Patent Number: 4,604,845

[45] Date of Patent: Aug. 12, 1986

[54] CONTINUOUS PIVOTED SPACING TIE

[76] Inventor: Sheridan F. Brinker, 1621 Sweem St., Oroville, Calif. 95965

[21] Appl. No.: 701,186

[22] Filed: Feb. 13, 1985

Related U.S. Application Data

[63] Continuation-in-part of Ser. No. 623,509, Jun. 22, 1984.

[51] Int. Cl.[4] ..... E04C 3/02

[52] U.S. Cl. ..... 52/696

[58] Field of Search ..... 52/105, 108, 317, 345, 52/347, 364–369, 417, 418, 488, 490, 693, 695, 696; 272/109

[56] References Cited

U.S. PATENT DOCUMENTS

| | | | |
|---|---|---|---|
| 1,106,845 | 8/1914 | Ream | 52/695 |
| 1,204,956 | 11/1916 | Day | 52/695 |
| 1,514,577 | 11/1924 | Burrell | 52/695 |
| 1,523,970 | 1/1925 | Sakos | 52/317 |
| 1,656,741 | 1/1928 | Lane | 52/695 |
| 2,964,807 | 12/1960 | Kennedy | 52/693 |
| 3,010,162 | 11/1961 | Klein | 52/696 |
| 3,334,461 | 8/1967 | York | 52/317 |
| 3,959,945 | 6/1976 | Allen | 52/690 |
| 4,040,232 | 8/1977 | Snow et al. | 52/693 |

FOREIGN PATENT DOCUMENTS

| | | | |
|---|---|---|---|
| 1021131 | 11/1977 | Canada | 52/693 |

*Primary Examiner*—John E. Murtagh
*Assistant Examiner*—Andrew Joseph Rudy
*Attorney, Agent, or Firm*—Norman B. Rainer

[57] ABSTRACT

A spacing brace apparatus is provided for temporarily interconnecting a number of wooden structural members in a parallel array, thereby minimizing the amount of working time needed to accurately arrange the wooden members. The apparatus is comprised of a series of rigid spacer segments of equal length pivotably interengaged in a manner permitting nested stacking in a compact storage state, and rapid deployment to a linearly sequenced working state. The apparatus facilitates equal spacing of the wooden members, yet permits variable spacing of the last wooden member of the array.

8 Claims, 5 Drawing Figures

CONTINUOUS PIVOTED SPACING TIE

RELATED APPLICATIONS

This is a continuation-in-part application based upon application Ser. No. 623,509, filed 06/22/84.

BACKGROUND OF THE INVENTION

This invention relates to brace elements for use in building and home construction, and more particularly concerns a spacing brace which can be quickly and easily utilized to temporarily interconnect a series of parallel wooden structural members.

In the construction of buildings, wooden structural members known as studs, joists, trusses and rafters are generally utilized wherein a number of such members are equidistantly disposed in a parallel array. The distance between said members is generally determined by measuring with a ruler and/or utilizing wooden strips of 1×2 inch or 1×4 inch cross section which are removably nailed into the structural members for temporary securement. Repeated measurements can be time-consuming and susceptible to random errors. Furthermore, after the structural members are fixed in their desired positions, any temporary wooden strips and their holding nails must be removed to permit the roof, wall or floor sheeting to be installed. Not only is such removel time-consuming, but the wooden strips are frequently discarded as scrap, resulting in the waste of expensive lumber and presenting a disposal problem.

It is also well known to nail bracing elements called ties between adjacent beams once the parallel array is formed in order to strangthen the array. Such procedure improves lateral stability and distributes loading forces throughout the array, but does not facilitate the initial positioning of the structural members.

It is accordingly an object of the present invention to provide apparatus to efficiently and economically position and engage wooden structural members such as trusses, joists, studs and rafters in an equidistantly spaced parallel array of a number of said structural members.

It is a further object of the present invention to provide apparatus as in the foregoing object capable of repeated re-use.

It is another object of the invention to provide apparatus of the aforesaid nature adapted to accommodate a last member of said array whose spacing from the penultimate member is different than the uniform spacing between other members of the array.

It is a still further object of this invention to provide apparatus of the aforesaid nature adapted to stabilize said array of structural members during construction work which eventually consolidates said array into a durable structure.

It is yet another object of the instant invention to provide a spacing apparatus which is easily utilized and amenable to economical manufacture.

These objects and other objects and advantages of the invention will be apparent from the following description.

SUMMARY OF THE INVENTION

The above and other beneficial objects and advantages are accomplished in accordance with the present invention by an apparatus comprising a series of rigid spacer segments pivotably interengaged in a manner permitting nested stacking in a storage state and rapid deployment to a linearly sequenced working state.

Each spacer segment is of substantially integral construction and comprised of: (a) a top panel of flat rectangular configuration elongated about a center longitudinal axis and having parallel first and second long side edges extending between short edge extremities which define the length of said panel, (b) a side panel of elongated flat rectangular configuration emergent from said first long side edge or alternating first and second long side edges of successive spacer segments, said side panel being of shorter length than said top panel and angled thereto, (c) tangs disposed at each extremity of said top panels as portions thereof extending beyond the length of the associated side panel, (d) fasteners located within said tangs and adapted to pivotably interengage adjacent spacer segments, and (e) a nail receiving aperture located within said fasteners. The first and last spacer segments have free or distal extremities whose tangs are without said fasteners.

In a preferred embodiment, the side panel of the first spacer segment is adapted to be shortened by an amount equal to half the width of the wooden members spanned by the apparatus.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
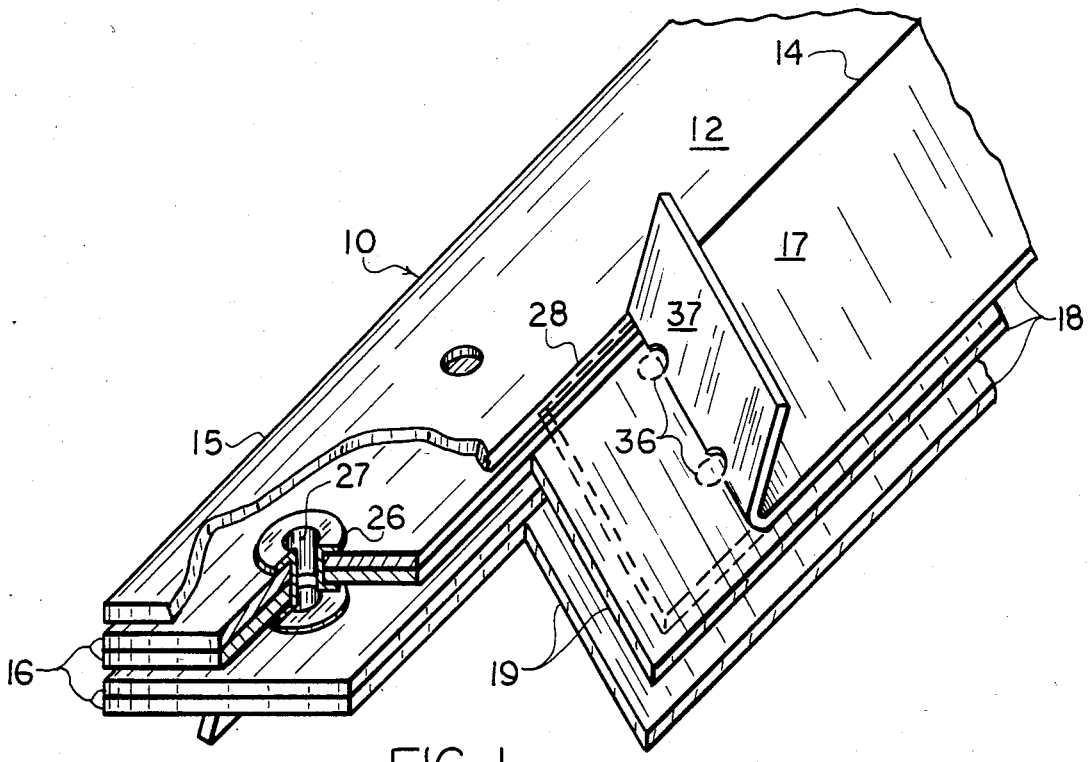
FIG. 1 is a perspective view of a spacing apparatus of this invention in its storage state.
Figure 2:
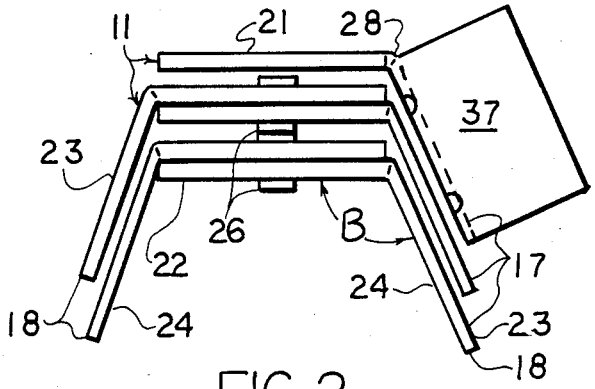
FIG. 2 is an end view of the apparatus of FIG. 1.
Figure 3:
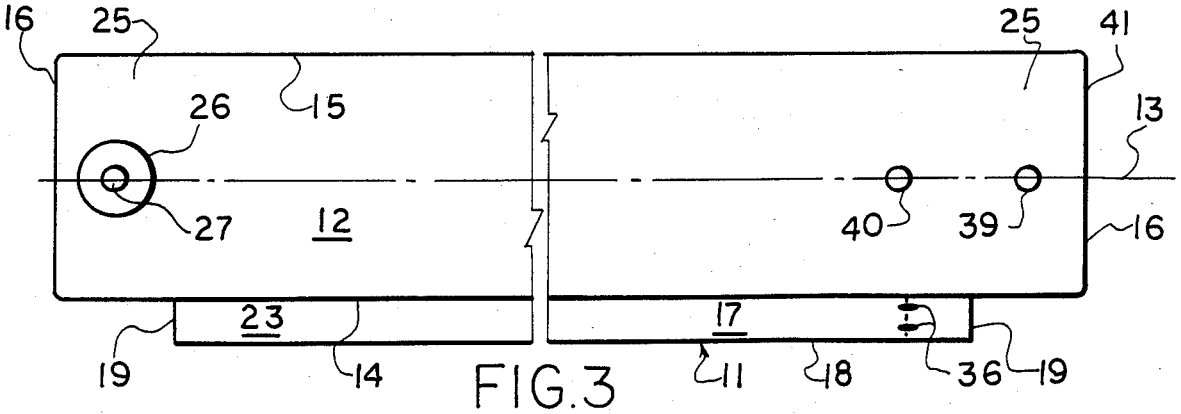
FIG. 3 is a top plan view of the first spacer segment of the apparatus of FIG. 1.

Referring now to FIGS. 1–3, the exemplified embodiment of the spacing apparatus 10 of this invention is comprised of a number of spacer segments 11 of substantially integral construction and preferably formed of 20 to 22 gauge sheet metal stock. Each segment 11 is comprised of a top panel 12 of rectangular configuration elongated about center longitudinal axis 13 and having flat upper and lower faces 21 and 22, respectively, and parallel first and second long side edges 14 and 15, respectively, extending between short edge extremities 16 which define the length of said top panel.

Side panel 17, of elongated flat rectangular configuration, emerges from first long side edge 14 as an integral extension of top panel 12 by virtue of having been formed by bending of the starting flat sheet metal stock along a line defining first long side edge 14. Side panel 17 is further bounded by distal edge 18, abutment ends 19, and upper and lower faces 23 and 24, respectively.

Figure 4:
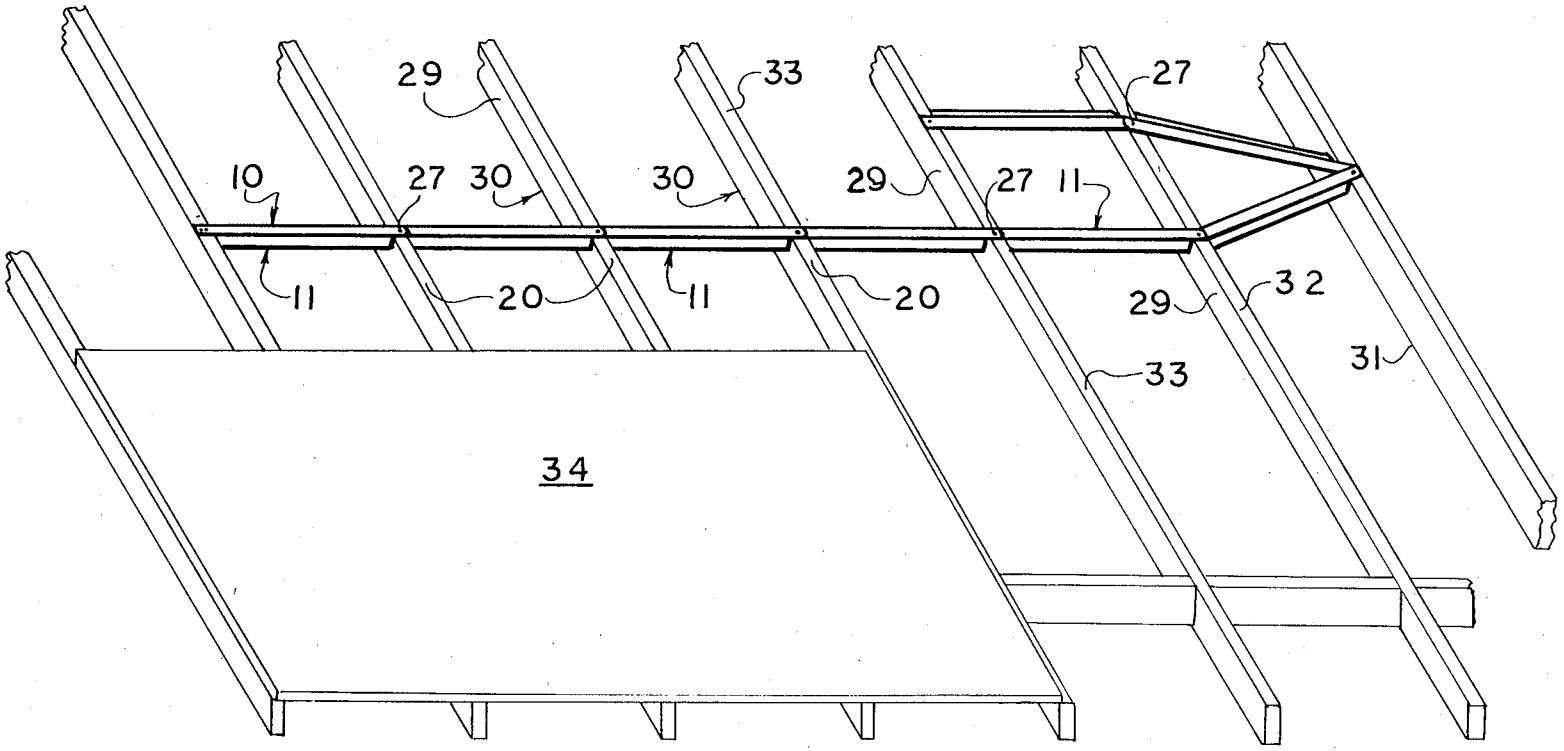
FIG. 4 is a perspective view of the spacer apparatus of FIG. 1 deployed to its working state and in spanning engagement with an array of wooden structural members.

Side panel 17 has a length, measured between abutment ends 19, shorter than side edge 14. The consequent gap 20 between adjacent abutment ends 19 in the deployed state shown in FIG. 4 is designed to be of a size adequate to closely accommodate the sidewalls of the wooden structural members. The shortened length of each side panel 17 is preferably achieved by the cutting away of appropriate portions of sheet material either prior to or subsequent to said bending. Side panel 17 is angled with respect to top panel 12 in a manner such that angle B, shown in FIG. 2 and measured between the lower surfaces of a top panel and its associated side panel, has a value between about 95° and 125°.

Tangs 25 are disposed at each extremity of said top panels as portions thereof extending beyond the length of said side panels. Fasteners in the form of ring-shaped hollow rivets or grommets 26 positioned in said tangs and centered on axis 13 pivotably interconnect adjacent spacer segments. The fasteners are provided with nail receiving apertures 27. To permit nested stacking, it is important that the tang of each successive spacer segment be positioned consistently beneath or above the tang of the preceding spacer segment. In securing said nested storage state, the segments are spirally rotated in the same direction when the side panel is consistently on the same side of the top panel. However, in embodiments of the apparatus wherein the side panel alternates between first and second long side edges, said spacer segments are rotated in alternating directions to produce an accordian-type back-and-forth folded configuration.

The first spacer segment of the apparatus, shown in the uppermost position of the nested state, is provided with slot 28 running along edge 14, and a line of perforations 36 in panel 17 perpendicularly disposed to the extremity of slot 28. Such configuration enables the side panel to be effectively shortened by the folding of its terminal portion upwardly to form an outwardly protruding tab 37 adapted to abut the first beam in the array spanned by the apparatus. The reason for such adjustability of the apparatus is that the spacing between the first and second beams in an array of rafters or the like is usually shorter by half the edge thickness of the beam than the spacing between subsequent beams. Such spacing permits the first edge of a plywood sheathing to fit flush alongside the first beam while subsequent edges of the sheathing are in abutting contact midway along the edge of each beam.

The first spacer segment, and also the last spacer segment of the apparatus, have free or distal extremities 41 which do not contain fasteners, but instead contain first and second nail-receiving apertures 39 and 40 whose functions will be explained hereinafter.

In operation, as shown in FIG. 4, the apparatus is deployed so that the successive spacing segments lie in a straight line. The gaps 20 between adjacent abutment ends 19 serve to accurately position wooden beams such as rafter beams 30, said abutment ends bearing against the side surfaces 29 of said beams. Nails may be driven through apertures 27 centered over the edges 33 of said beams. Once the array of beams is stabilized, as by installation of plywood sheathing 34, the nails and the apparatus may be removed.

Whereas the spacing between adjacent rafter beams is generally standardized at twenty-four inches, the last beam 31, generally called a gable end truss, will usually be spaced from the penultimate beam 32 by whatever distance is required to complete the overall length of the array of beams. Accordingly, the spacing of the gable end truss will vary with different building constructions.

The apparatus of this invention accommodates to the variable spacing of the gable end truss by permitting adjustment of the requisite spacer segments to angled orientations away from the straight line path of the remainder of the spacer segments. In such manner, the spacer segments may extend to contact with the gable end truss and may return to further engagement with the other beams of the array. Such unique capability of the apparatus of this invention enhances its versatility not only in the exemplified construction of roof structures, but also in the construction of wall and floor structures.

Figure 5:
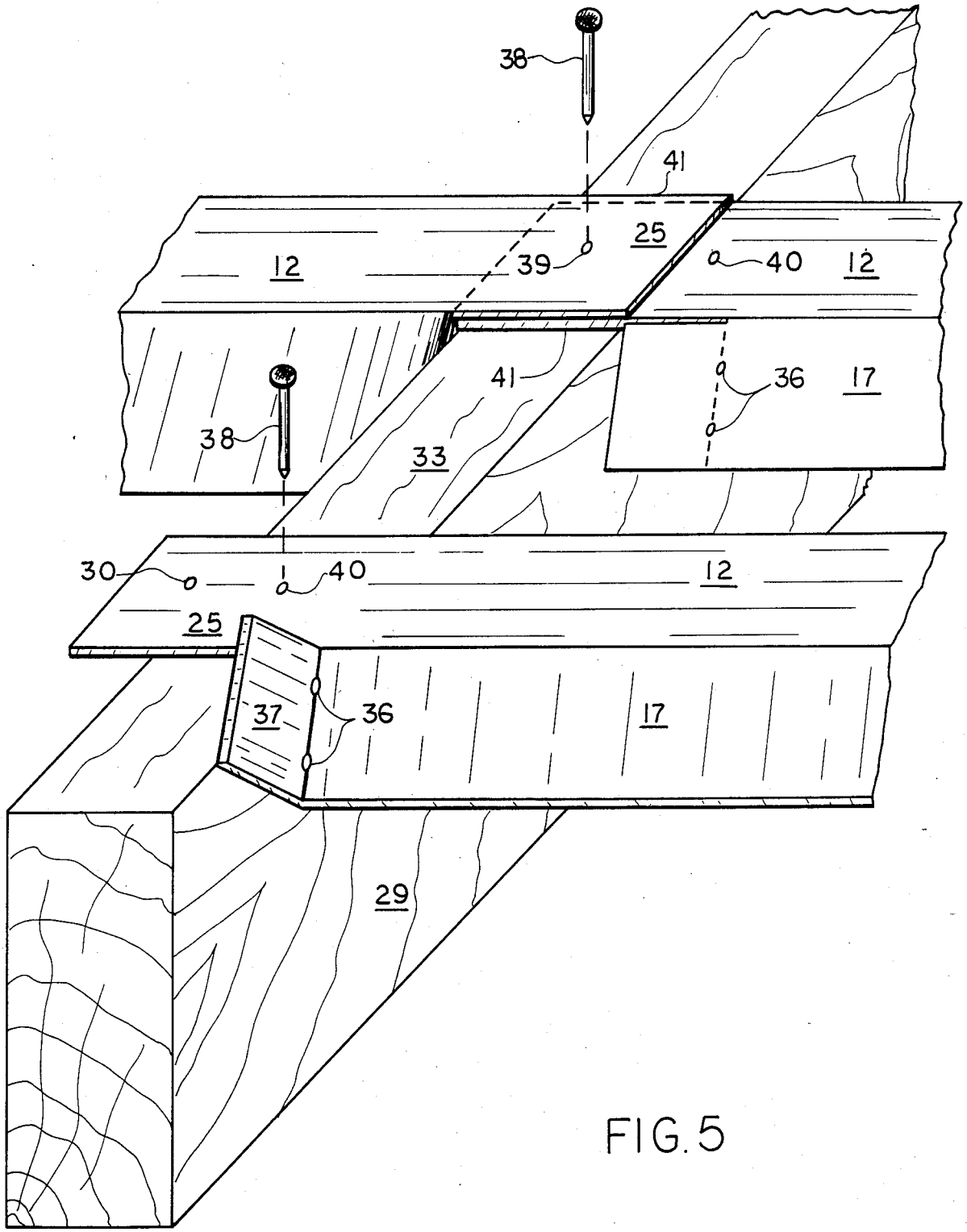
FIG. 5 is an enlarged perspective fragmentary view of the first spacer segment in two different modes of use.

FIG. 5 illustrates two different modes of use of the apparatus, particularly insofar as the first spacer segment is concerned. In the uppermost exemplified mode, two units of the apparatus of this invention are interengaged above the edge 33 of a beam by means of nails 38 which penetrate aligned first auxiliary apertures 39 in overlapped tangs 25 of distal extremities 41. In the lowermost exemplified mode, the first spacer segment of a single apparatus is fastened to edge 33 by means of nail 38 which penetrates second auxiliary aperture 40 in tang 25. In said lowermost mode, it is to be further noted that tab 37 is upraised from side panel 17 and in abutment with side surface 29 of the beam, thereby causing the distance of spacing to the next beam (not shown) to be slightly shorter than would be the case for subsequent beams.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described the invention, what is claimed is:

1. A spacing brace apparatus for temporarily interconnecting a number of wooden structural members in a parallel array comprising a series of rigid spacer segments of equal length pivotably interengaged in a manner permitting nested stacking in a storage state and rapid deployment to a linearly sequenced working state, each spacer segment being of substantially integral construction and comprised of: (a) a top panel of flat rectangular configuration elongated about a center longitudinal axis and having parallel first and second long side edges extending between short edge extremities which define the length of said panel, (b) a side panel of elongated flat rectangular configuration emergent from alternating first and second long side edges of successive spacer segments, said side panel being of shorter length than said top panel and angled thereto, (c) tangs disposed at each extremity of said top panels as portions thereof extending beyond the length of the associated side panel, (d) fasteners located within said tangs and adapted to pivotably interengage adjacent spacer segments, and (e) a nail receiving aperture located within said fasteners, the first and last spacer segments of said series having free distal extremities whose tangs are without said fasteners.

2. The apparatus of claim 1 wherein said distal extremities are provided with auxiliary nail receiving apertures.

3. The apparatus of claim 2 wherein said first spacer segment is uppermost in said stacked storage state.

4. The apparatus of claim 3 wherein the side panel adjacent the distal extremity of said first spacer segment is adapted to be optionally shortened by an amount equal to half the width of the wooden members interconnected by the apparatus.

5. The apparatus of claim 4 wherein the angle between said top and side panels is between about 95° and 125°.

6. A spacing brace apparatus for temporarily interconnecting a number of wooden structural members in a parallel array comprising a series of rigid spacer segments of equal length pivotably interengaged in a manner permitting nested stacking in a storage state and rapid deployment to a linearly sequenced working state, each spacer segment being of substantially integral construction and comprised of: (a) a top panel of flat rectangular configuration elongated about a center longitudinal axis and having parallel first and second long side edges extending between short edge extremities which define the length of said panel, (b) a side panel of elongated flat rectangular configuration emergent from said first long side edge and of shorter length than said top panel and angled thereto, (c) tangs disposed at each extremity of said top panels as portions thereof extending beyond the length of the associated side panel, (d) fasteners located within said tangs and adapted to pivotally interengage adjacent spacer segments, and (e) a nail receiving aperture located within said fasteners, the first and last spacer segments of said series having free distal extremities whose tangs are without said fasteners.

7. The apparatus of claim 6 wherein said nested state is secured by spirally rotating the spacer segments in the same direction.

8. The apparatus of claim 1 wherein said nested storage state is secured by rotating the spacer segments in alternating directions in an accordian-type back and forth manner to produce a folded configuration.

* * * * *